2/11/86 XR 4,569,752

United States Patent [19]

Aldridge et al.

[11] Patent Number: 4,569,752

[45] Date of Patent: Feb. 11, 1986

[54] COMBINATION COKING AND HYDROCONVERSION PROCESS

[75] Inventors: Clyde L. Aldridge; Roby Bearden, Jr., both of Baton Rouge, La.

[73] Assignee: Exxon Research and Engineering Co., Florham Park, N.J.

[21] Appl. No.: 676,864

[22] Filed: Nov. 30, 1984

Related U.S. Application Data

[63] Continuation-in-part of Ser. No. 561,476, Dec. 14, 1983, abandoned.

[51] Int. Cl.[4] ..... C10G 69/06; C10G 69/10; C10G 69/00

[52] U.S. Cl. ..... 208/53; 208/68; 208/54; 208/55; 208/50

[58] Field of Search ..... 208/54, 53, 50, 55, 208/131, 111, 68

[56] References Cited

U.S. PATENT DOCUMENTS

| | | | |
|---|---|---|---|
| 2,614,067 | 10/1952 | Reed et al. . | |
| 2,888,393 | 5/1959 | Ballard et al. . | |
| 3,238,117 | 3/1966 | Arey, Jr. et al. | 208/53 |
| 3,245,900 | 4/1966 | Paterson . | |
| 3,269,958 | 8/1966 | Gatsis | 208/216 R |
| 3,684,689 | 8/1972 | Patton et al. | 208/54 |
| 4,134,825 | 1/1979 | Bearden, Jr. et al. . | |
| 4,178,227 | 12/1979 | Metrailer et al. . | |
| 4,204,943 | 5/1980 | Metrailer et al. . | |
| 4,226,742 | 10/1980 | Bearden, Jr. et al. . | |
| 4,295,996 | 10/1981 | Bearden, Jr. et al. . | |

OTHER PUBLICATIONS

Bridge et al., "Residue Processes Proven" Oil and Gas Journal, Jan. 19, 1981, pp. 85-98.

*Primary Examiner*—D. E. Gantz
*Assistant Examiner*—Chung K. Pak
*Attorney, Agent, or Firm*—Marthe L. Gibbons

[57] ABSTRACT

A carbonaceous feed, such as a heavy hydrocarbonaceous oil or coal, and mixtures thereof, is upgraded by a combination coking and catalytic slurry hydroconversion process in which a catalyst precursor is added to the feed of the hydroconversion zone as a catalyst precursor concentrate prepared from a virgin hydrocarbonaceous oil and a thermally decomposable or oil dispersible metal compound.

11 Claims, 1 Drawing Figure

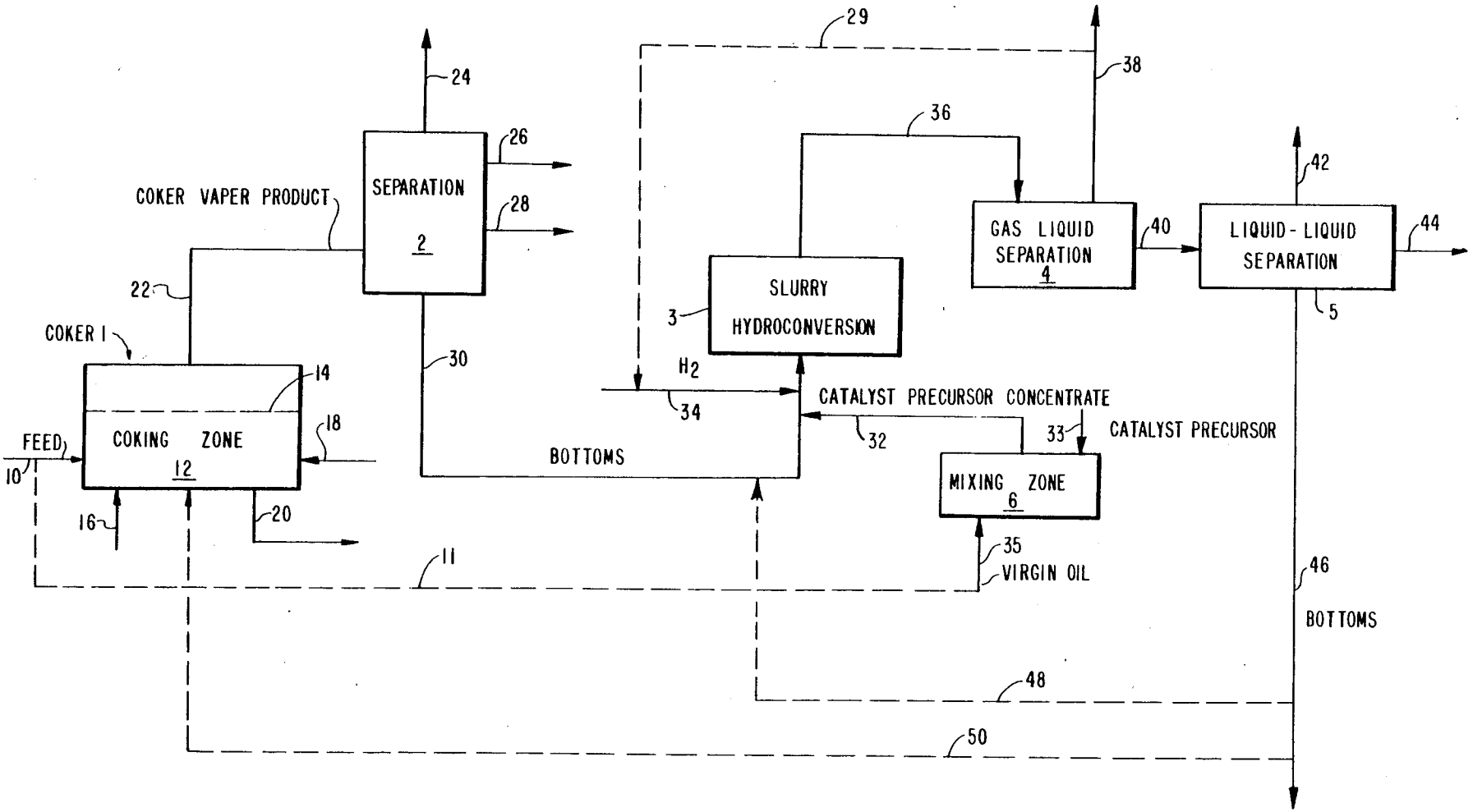
LIQUID - LIQUID SEPARATION
5
42
44
46
BOTTOMS
GAS LIQUID SEPARATION 4
40
38
CATALYST PRECURSOR
MIXING ZONE 6
33
35
VIRGIN OIL
CATALYST PRECURSOR CONCENTRATE
32
48
50
36
29
SLURRY HYDROCONVERSION
3
H2
34
BOTTOMS
SEPARATION 2
24
26
28
30
11
COKER VAPER PRODUCT
22
COKING ZONE 12
14
18
20
16
COKER I
FEED
10

COMBINATION COKING AND HYDROCONVERSION PROCESS

CROSS REFERENCE TO RELATED APPLICATIONS

This application is a continuation-in-part of U.S. patent application Ser. No. 561,476, filed Dec. 14, 1983 now abandoned, the teachings of which are hereby incorporated by reference.

BACKGROUND OF THE INVENTION

1. Field of the Invention

The present invention relates to an integrated coking and hydroconversion process for upgrading carbonaceous materials.

2. Description of the Prior Art

Coking is a well-known process. The fluid coking process is described, for example, in U.S. Pat. No. 2,881,130, the teachings of which are hereby incorporated by reference. The fluid coking process can be conducted with or without recycle of the heavy normally liquid constituents of the coking product. When the heavy normally liquid constituents of the coker product are not recycled to the coking zone, the process is referred to as "once-through" coking. Integrated fluid coking and coke gasification processes are also known and disclosed, for example, in U.S. Pat. Nos. 3,702,516; 3,759,676, and 4,325,815, the teachings of which are hereby incorporated by reference. Delayed coking is a well-known process in which a hydrocarbonaceous oil is heated to a cracking temperature and then passed into a coking drum to produce a vapor phase product, including hydrocarbons and coke. The drum is decoked by hydraulic or by mechanical means. See *Hydrocarbon Processing,* September 1980, page 153.

U.S. Pat. No. 4,134,825 discloses a catalytic slurry hydroconversion process conducted at a pressure of 500 to 5000 psig and at elevated temperatures. The catalyst is produced in an oil feed from a catalyst precursor.

The term "hydroconversion" is used herein to designate a process conducted in the presence of hydrogen in which at least a portion of the heavy constituents of a hydrocarbonaceous oil is converted to lower boiling products while simultaneously reducing the concentration of nitrogenous compounds, sulphur compounds and metallic contaminants.

U.S. Pat. No. 3,684,689 discloses fluid coking a residuum. The coker bottoms are passed to a hydrocracking zone. The stream passed to the hydrocracking zone is a gas oil (see column 3, line 74, and column 6, lines 72–73).

U.S. Pat. No. 2,614,067 discloses coking a topped crude oil in a fluid coker. A gas oil fraction from a fractionator is used as absorber oil in an absorber. The absorber bottoms are passed to a slurry hydrogenation reactor. The absorber bottoms do not seem to include constituents boiling above 1050° F.

U.S. Pat. No. 3,245,900 discloses coking a residuum and sending the coker distillate to a hydrocracking zone.

U.S. Pat. No. 4,226,742 discloses preparation of a catalyst in situ in virgin hydrocarbonaceous oils. See also U.S. Pat. No. 4,295,996, which discloses preparation of a catalyst on an alloy support.

U.S. Pat. No. 2,888,393 discloses fluid coking at a pressure of 200 to 2000 psig and hydrogenating the entire coker effluent at a pressure ranging from 200 to 2000 psig.

U.S. Pat. Nos. 4,204,943; 4,178,227, and 4,169,038 disclose combination hydroconversion and coking in which the bottoms portion of the hydroconverted product is used as feed to the coking zone.

It has now been found that an integrated coking and hydroconversion process in which the coker bottoms, including materials boiling above 1050° F., are further converted in a catalytic slurry hydroconversion stage utilizing a specified catalyst, will provide advantages that will become apparent in the ensuing description.

All boiling points referred to herein are atmospheric pressure equivalent boiling points unless otherwise specified.

SUMMARY OF THE INVENTION

In accordance with the invention, there is provided an integrated coking and hydroconversion process which comprises the steps of:

(a) treating a carbonaceous feed having a Conradson carbon content of at least 5 weight percent in a coking zone at coking conditions, including a pressure ranging from zero to about 100 psig, to produce coke and a vapor phase product, including hydrocarbons comprising constituents boiling above 1050° F.;

(b) separating a heavy bottoms fraction having a Conradson carbon content of at least about 5 weight percent, including said constituents boiling above 1050° F., from said hydrocarbons;

(c) adding a hydroconversion catalyst precursor to at least a portion of said heavy bottoms fraction to form a mixture, said catalyst precursor being added to said bottoms portion as a catalyst precursor in a virgin hydrocarbonaceous oil comprising constituents boiling above 1050° F., and (d) subjecting at least a portion of said mixture of step (c) to hydroconversion conditions in the presence of hydrogen in a slurry hydroconversion zone to produce a hydroconverted oil.

BRIEF DESCRIPTION OF THE DRAWING

The FIGURE is a schematic flow plan of one embodiment of the invention.

DESCRIPTION OF THE PREFERRED EMBODIMENT

The integrated process of the present invention comprises coking and slurry hydroconversion of the coker bottoms. The coking process may be fluid coking or delayed coking. Preferably, the coking process is fluid coking. Delayed coking conditions are well known and include a temperature ranging from about 775° F. to about 1000° F. and a pressure ranging from about 10 to about 200 psig. The preferred embodiment will be described with reference to the accompanying FIGURE.

Referring to the FIGURE, a carbonaceous material is passed by line 10 into coking zone 12 in coker 1 in which is maintained a fluidized bed of solids, e.g., coke particles of 40 to 1000 microns in size shown as having an upper level 14.

CARBONACEOUS FEEDS

Suitable feeds for introduction into coking zone 12 include heavy hydrocarbonaceous oils; heavy and reduced petroleum crude oil; petroleum atmospheric distillation bottoms; petroleum vacuum distillation bottoms; pitch, asphalt; bitumen; other heavy hydrocarbon residues; tar sand oil; shale oil, coal; coal slurries; liquid products derived from coal liquefaction processes, including coal liquefaction bottoms, and mixtures thereof. Typically, such feeds have a Conradson carbon content of at least 5 weight percent, generally from about 5 to about 50 weight percent, preferably above about 7 weight percent (as to Conradson carbon residue, see ASTM Test D189-65). Preferably the feed is a hydrocarbonaceous oil comprising at least 10 weight percent of materials boiling above 1050° F. A fluidizing gas, e.g., steam, is admitted at the base of coker 1 through line 16 in an amount sufficient to obtain a superficial fluidizing gas velocity in the range of 0.5 to 5 feet per second. The fluidizing gas may comprise steam, vaporized normally liquid hydrocarbons, normally gaseous hydrocarbons, hydrogen, hydrogen sulfide and mixtures thereof. Typically, the fluidizing gas will comprise steam. Solids at a temperature above the coking temperature, for example, 100 to 1000 Fahrenheit degrees above the actual operating temperature of the coking zone are admitted to coker 1 by line 18 in an amount sufficient to maintain the coking temperature in the range of about 850° to about 1400° F., preferably from about 900° to about 1200° F. The pressure in the coking zone is maintained suitably in the range of about zero to about 100 pounds per square inch gauge, (psig), preferably in the range of about 5 to about 45 psig. The lower portion of the coker serves as a stripping zone to remove occluded hydrocarbons from the solids. A stream of stripped solids is withdrawn from coker 1 by line 20 for passage to a gasifier (not shown) or to a heater (not shown) to heat the solids. The heater may be operated as a conventional coke burner as disclosed in U.S. Pat. No. 2,881,130, the teachings of which are hereby incorporated by reference. Alternatively, the heater may be operated as a heat exchange zone such as disclosed in U.S. Pat. Nos. 3,661,543; 3,702,516 and 3,759,676, the teachings of which are hereby incorporated by reference. The heated solids are recycled to coker 1 by line 16 to supply heat for the endothermic coking reaction. The vaporous coker product, which comprises light hydrocarbons and heavy hydrocarbons, including materials boiling above 1050° C., is passed by line 22 to separation zone 2 which may be a scrubbing zone or a fractionation zone. In separation zone 2, the coker vapor phase product is separated into a gas removed by line 24, a light boiling hydrocarbonaceous stream removed by line 26, and an intermediate boiling fraction removed by line 28. A heavy bottoms fraction, including materials boiling above 1050° F., is removed by line 30. The heavy bottoms fraction removed by line 30 has a Conradson carbon content of at least 5 weight percent, preferably at least 7 weight percent and generally comprises at least about 10 weight percent materials boiling above 1050° F. The initial boiling point of the heavy bottoms fraction 30 may range from about 650° to about 1050° F. Preferably, the initial boiling point is at least about 975° F. If desired, a portion of the fresh feed carried in line 10 may be introduced directly into the heavy bottoms fraction carried in line 30. A catalyst precursor concentrate is added by line 32 to the bottoms fraction carried in line 30. Alternatively, the catalyst precursor concentrate may be introduced directly into slurry hydroconversion zone 3. A hydrogen-containing gas is introduced by line 34 into line 30 or directly into hydroconversion zone 3.

THE HYDROCONVERSION CATALYST

The hydroconversion catalyst precursor concentrate added to the heavy bottoms fraction either in line 30 or in zone 3 is prepared by introducing a thermally decomposable metal compound or an oil dispersible metal compound by line 33 into mixing zone 6 and introducing a virgin hydrocarbonaceous oil having constituents boiling above 1050° F., preferably having at least 10 weight percent constituents boiling above 1050° F., by line 35 into mixing zone 6. The virgin oil may be the same as the feed introduced into coking zone 12, for example, by removing a portion of feed 10 by line 11 or the virgin oil introduced into mixing zone 6 may be a hydrocarbonaceous oil boiling at atmospheric pressure above about 430° F., preferably above about 500° F., more preferably above about 650° F. The virgin hydrocarbonaceous oil may be derived from petroleum, tar sand oil, and mixtures thereof. Preferably, the virgin oil is a heavy petroleum oil. Most preferably, the virgin oil is a virgin petroleum crude oil or a virgin petroleum residuum such as atmospheric and vacuum residua. The term "virgin", relative to oil, is used herein to connote an oil that has not been cracked either thermally or catalytically. Suitable thermally decomposable metal compounds include inorganic poly acids such as isopoly and heteropoly acids; metal carbonyls, metal halides, metal salts of organic acids such as acyclic and alicyclic aliphatic carboxylic acids containing two or more carbon atoms (e.g., naphthenic acids). The metal constituent of the thermally decomposable metal compound is selected from Groups II, III, IVB, VB, VIB, VIIB and VIII of the Periodic Table of Elements and mixtures thereof, in accordance with the table published by Sargent-Welch Scientific Company, for example, zinc, antimony, bismuth, titanium, cerium, zirconium, vanadium, niobium, tantalum, chromium, molybdenum, tungsten, manganese, rhenium, iron, cobalt, nickel and the noble metals, including platinum, iridium, palladium, osmium, ruthenium, rhodium and mixtures thereof. The preferred metal constituent of the thermally decomposable metal compound is selected from the group consisting of Group VB and Group VIB of the Periodic Table of Elements and mixtures thereof. The preferred thermally decomposable metal compounds are inorganic poly acids, including isopoly acids and heteropoly acids of metals selected from Groups VB and VIB and mixtures thereof, that is, vanadium, niobium, chromium, molybdenum, tungsten and mixtures thereof. Suitable inorganic poly acids include phosphomolybdic acid, phosphotungstic acid, phosphovanadic acid, silicomolybdic acid, silico-tungstic acid, silicovanadic acid and mixtures thereof. The preferred metal constituent of the poly acid is selected from the group consisting of molybdenum, vanadium and chromium. The preferred poly acid is phosphomolybdic acid. The virgin oil comprising the catalyst precursor, hereinafter designated "catalyst precursor concentrate", is removed from mixing zone 6 by line 32 and introduced into the coker bottoms portion carried in line 30. Alternatively, or additionally, the catalyst precursor concentrate of line 32 may be introduced directly into hydroconversion zone 3. The catalyst precursor present in the concentrate will be converted to a catalyst at hydroconversion conditions in the hydroconversion zone as described in U.S. Pat. No. 4,226,742. The catalyst precursor concentrate (i.e., catalyst precursor in virgin oil) is added to the coker bottoms in an amount sufficient to provide from about 10 to about 1000 wppm metal, preferably from about 20 to 500 wppm metal, more preferably from about 30 to about 200 wppm metal, calculated as elemental metal, based on the total hydroconversion zone feed, i.e., concentrate plus heavy coker bottoms.

SLURRY HYDROCONVERSION OPERATING CONDITIONS

Suitable conditions in the slurry hydroconversion zone are summarized in Table I.

TABLE I

| Conditions | Broad Range | Preferred Range |
|---|---|---|
| Temperature, °F. | 650 to 1000 | 800 to 900 |
| Hydrogen Partial Pressure, psig | 100 to 5000 | 300 to 2000 |

Although it is preferred to operate at higher pressures, relatively low pressures can be used to obtain a significant conversion when utilized in combination with certain temperatures. Table II summarizes preferred combination conditions.

TABLE II

| Hydroconversion | 100–499 | 500–999 | 1000–2000 |
|---|---|---|---|
| $H_2$ Partial Pressure, psig | | | |
| Temperature, °F. | | | |
| Broad | 750–820 | 750–875 | 750–900 |
| Preferred | 760–800 | 780–840 | 800–850 |

In the slurry hydroconversion zone, at least 10 percent, preferably at least 50 percent, more preferably at least 75 percent by weight of the materials boiling above 1050° F. that are present in the heavy bottoms fraction subjected to slurry hydroconversion conditions is converted to lower boiling products.

The hydroconversion zone effluent is removed by line 36 and passed into a gas-liquid separation zone 4 wherein the normally gaseous phase is separated from a normally liquid phase. The gaseous phase is removed from separation zone 4 by line 38. Alternatively, the gaseous phase, which comprises hydrogen, may be recycled by line 29, preferably after removal of undesired constituents, to the slurry hydroconversion zone via line 34. The normally liquid phase, which comprises the hydroconverted hydrocarbonaceous oil having a decreased Conradson carbon, is passed by line 40 to separation zone 5 for fractionation by conventional means such as distillation into various fractions such as light, medium boiling and heavy bottoms fractions. The light fraction is removed by line 42. The medium boiling fraction is removed by line 44. The heavy bottoms fraction is removed by line 46 and, if desired, at least a portion of the bottoms fraction may be recycled to hydroconversion zone 3 by line 48 and/or to coking zone 12 by line 50.

The following examples are provided to illustrate the invention.

EXAMPLE 1

Heavy Arabian vacuum residuum was subjected to fluid coking at a reactor temperature of 950° F. operating in a once-through mode to produce a coker product containing a 975+°F. fraction. The 975+°F. fraction had the inspections shown in Table III:

TABLE III

| | |
|---|---|
| API gravity at 60° F. | 1.65 |
| Sulfur, wt. % | 5.7 |
| Nitrogen, wt. % | 0.42 |
| Conradson carbon, wt. % | 23.7 |
| 1050 + °F. fraction, wt. %[a] | 75.50 |
| Ni, wppm | 7.0 |
| V, wppm | 30.0 |
| Fe, wppm | 13.0 |
| C, wt. % | 84.3 |
| H, wt. % | 9.0 |

[a]Determined by ASTM D1160 Distillation

This 975+°F. fraction was subjected to hydroconversion experiments as described in the following examples.

EXAMPLE 2

Hydroconversion experiments using a catalyst concentrate prepared in a virgin feed were conducted. The conditions and results are summarized in Table IV:

TABLE IV

HYDROCONVERSION OF HEAVY FEEDS
830° F., 3 hr., 500 psig,
10.5% $H_2S$/89.5% $H_2$ charged,
3000 SCF/bbl $H_2$ flow;
250 ppm Mo

| Experiment | A (Run 947) | B (Run 946) | C (Run 871) |
|---|---|---|---|
| Catalyst Concentrate | 20% PMA (1) phenol in 56.4% Virgin Heavy Arab Vacuum Bottoms/ 43.6% Heavy Arab VGO, at 2000 ppm Mo | Same as "A" | 20% PMA/ phenol in 56.4% Heavy Arab coker bottoms/ 43.6% Heavy Arab VGO(2), at 2000 ppm Mo |
| Feedstock | Virgin Heavy Arab Bottoms | Heavy Arab Coker Vacuum Bottoms | Heavy Arab Coker Vacuum Bottoms |
| Toluene Insoluble Coke wt. % on Vacuum Bottoms | 25.85 | 3.18 | 8.18 |
| $C_1$–$C_3$ Gas on Vacuum Bottoms | 9.32 | 9.52 | 9.31 |
| $C_4$ + oil, wt. % on Vacuum Bottoms | 64.8 | 87.3 | 82.5 |
| 975 + °F. Fraction Converted to 975-°F. Oil + Gas | 67 | 75 | 71 |

(1)PMA means phosphomolybdic acid
(2)VGO means vacuum gas oil

As can be seen from the above table, Experiment B, which was an experiment in accordance with the process of the present invention, gave superior results in terms of lower coke yield and higher conversion than Experiment A, which was an example of hydroconversion of virgin vacuum bottoms using a catalyst precursor concentrate prepared in said virgin bottoms and also superior to Experiment C, which was an example of hydroconversion of once-through coker bottoms using a catalyst precursor concentrate prepared in said once-through coker bottoms. The combination of the superior once-through coker bottoms as a hydroconversion feed and the superior virgin bottoms as a catalyst precursor vehicle produces a superior overall process, with increased liquid and gas yields.

EXAMPLE 3 (362L)

Preparation of catalyst precursor concentrate in once-through coker bottoms

A blend of 56.4 weight percent once-through coker vacuum bottoms derived from coking of heavy Arabian residuum was made with 43.6 weight percent heavy Arabian vacuum gas oil as viscosity reducer and aid to mixing.

Three hundred ninety-two grams of this coker bottoms blend was charged to a 1 liter Autoclave Engineers magnetically stirred autoclave together with 8.00 g of a 20.0 weight percent solution of phosphomolybdic acid in phenol. The autoclave was flushed with nitrogen and heated with stirring to 300° F. and held at this temperature with stirring for 15 minutes and then cooled. This catalyst precursor concentrate contained 2000 wppm Mo.

EXAMPLE 4 (352L)

Preparation of catalyst precursor concentrate in virgin heavy Arabian residuum

A blend of 56.4 weight percent virgin heavy Arabian vacuum residuum was made with 43.6 weight percent heavy Arabian vacuum gas oil as viscosity reducer and aid to mixing.

Three hundred ninety-two grams of this virgin heavy Arabian vacuum residuum blend was charged to a 1 liter Autoclave Engineers magnetically stirred autoclave, together with 8.00 g of a 20.0 weight percent solution of phosphomolybdic acid in phenol. This mixture was blended as described in Example 1. This catalyst precursor concentrate contained 2000 wppm Mo.

EXAMPLE 5 (Run 946)

An example of the process of this invention

One hundred and five grams of coker vacuum bottoms of Example 1 was charged to a 300 cc Autoclave Engineers magnetically stirred autoclave, together with 15.0 grams of catalyst precursor concentrate of Example 4. This amount of charge and catalyst precursor concentrate gave a molybdenum concentration of 250 wppm on the total charge. The autoclave was flushed with $H_2$, pressured with 38 psia of $H_2S$ and then pressured to 360 psig with hydrogen. The autoclave was then heated with stirring to 800° F., whereupon the total pressure was 500 psig. A flow of 0.26 l/min. $H_2$, as measured at atmospheric ambient conditions, was established and the reaction conducted for 3 hours.

After 3 hours reaction time, the autoclave was blocked off and cooled. The flow-through gas and the autoclave final gas were collected separately in butyl balloons, measured and analyzed by mass spectrometry to determine gas yields and hydrogen partial pressure in the autoclave.

The autoclave contents were diluted to 360 g total weight with toluene and filtered to recover toluene insoluble coke and liquid separately. The coke weighed, after vacuum drying at 100° C., 3.61 g.

The toluene solution of product liquid was vacuum distilled to 975°F. cut point and 24.8 g of material boiling above 975° F. recovered as bottoms. This unconverted 975+°F. material had a Conradson carbon content of 68.92 percent.

The 975+°F. conversion to 975−°F. liquid and gas was 75 percent. The coke yield on vacuum bottoms feed was 3.18%, the $C_1$–$C_3$ gas was 9.52%, and the total $C_4$+ oil was 87.3%

EXAMPLE 6 (Run 947)

This is a comparative example and not an example of the present invention

An experiment was carried out according to Example 5, except that the feedstock was 105.0 grams of virgin heavy Arabian vacuum bottoms.

The 975+°F. conversion to 975−°F. liquid and gas was 67%. The coke yield on vacuum bottoms was 25.85 weight percent, the $C_1$–$C_3$ gas was 9.32%, and the total $C_4$+ oil was 64.83%.

EXAMPLE 7 (Run 871)

This is a comparative example and not an example of this invention

An experiment was carried out according to Example 5, except that the catalyst concentrate was that of Example 3. The 975+°F. conversion to 975−°F. liquid and gas was 71%. The coke yield on vacuum bottoms was 8.18%, the $C_1$–$C_3$ gas was 9.31%, and the total $C_4$+ oil was 82.51%.

EXAMPLE 8

Unexpectedly, it has been found that the coprocessing of heavy Arab vacuum residuum with once-through coker bottoms derived from heavy Arab vacuum residuum can result, depending on blend composition, in conversion synergism, i.e., the conversion of 975° F.+ bottoms can be higher than obtained with either of these feeds alone.

This effect is illustrated by the following series of experiments.

Hydroconversion experiments were performed utilizing as feed either a heavy Arab vacuum residuum that contained 88.6 weight percent of 975+°F. bottoms, or the 975+°F. once-through coker bottoms product described in Example 1, or blends of these two feeds in the proportions set out in Table V. The catalyst precursor concentrate that was used in each experiment was prepared by injecting a solution of 0.8 g of phosphomolybdic acid (50% Mo) in 9.2 g water into 90 g of virgin heavy Arab atmospheric residuum (50% 975+°F. bottoms) while stirring at 158° F., followed by removal of water by heating to 300° F. and stripping with nitrogen for 10 minutes.

In carrying out the hydroconversion experiments, a 300 cc Autoclave Engineers magnetically stirred autoclave was charged with 109.5 g of either the vacuum residuum, or 975+°F. coker bottoms product, or a mixture of these two feeds (as designated for the individual runs in Table V) along with 3.60 g of heavy Arab atmospheric residuum and 6.90 g of the catalyst precursor concentrate, which concentrate furnished 0.03 g of Mo and 6.87 g of heavy Arab atmospheric residuum. The autoclave was then flushed with hydrogen and heated with stirring to 158° F. for a 15-minute stirred contact. Upon cooling to room temperature the autoclave was charged with 50 psia hydrogen sulfide and 1350 psia hydrogen, then heated with stirring from room temperature up to 725° F. and held with stirring for a period of 20 minutes. At this point autoclave pressure was adjusted to 2100 psig, a flow of hydrogen was begun, temperature was increased to 830° F. and a hydroconversion reaction of 3.0 hours duration was carried out at 2100 psig while maintaining a gas flow (measured at reactor outlet at atmospheric temperature and pressure after scrubbing with caustic to remove hydrogen sulfide) of 0.36 liters per minute.

After the reaction period the autoclave was cooled, the autoclave gases collected, measured and analyzed. The autoclave contents were washed out with 360 g of toluene and the solution filtered to isolate toluene insoluble coke. The filtered toluene solution was distilled to recover the unconverted 975+°F. bottoms material.

The synergistic effect on 975+°F. bottoms conversion obtained by using blends of once-through coker bottoms with virgin vacuum residuum can be seen by comparing the results of experiments numbers R-1599, R1600, and R1608 with experiments R-1557 and R1598.

TABLE V

HYDROCONVERSION OF BLENDS OF HAVR[1] WITH COKER BOTTOMS FROM HAVR

| RUN NO. | FFED COMP., GRAMS HAAR[2] | HAVR | CKR BTMS[3] | 975+° F. CONVERSION, % | TOLUENE INSOL. COKE, % ON. TOTAL FEED |
|---|---|---|---|---|---|
| R-1557 | 10.48 | 109.50 | 0.00 | 84.6 | 1.36 |
| R-1599 | 10.48 | 97.50 | 12.00 | 86.7 | 1.29 |
| R-1600 | 10.48 | 79.50 | 30.00 | 84.8 | 0.82 |
| R-1608 | 10.48 | 60.00 | 49.50 | 88.7 | 0.73 |
| R-1598 | 10.48 | 0.00 | 109.50 | 84.2 | 0.03 |

[1]HAVR = HEAVY ARAB VACUUM RESID
[2]HAAR = HEAVY ARAB ATMOSPHERIC RESID
[3]CKR BTMS = COKER BOTTOMS

What is claimed is:

1. An integrated coking and hydroconversion process which comprises the steps of:

(a) treating a carbonaceous feed having a Conradson carbon content of at least 5 weight percent in a coking zone at coking conditions, including a pressure ranging from zero to about 100 psig, to produce coke and a vapor phase product, including hydrocarbons boiling above 1050° F.;

(b) separating a heavy bottoms fraction having a Conradson carbon content of at least about 5 weight percent, including said hydrocarbons boiling above 1050° F. from said vapor phase product;

(c) adding a hydroconversion catalyst precursor to at least a portion of said heavy bottoms fraction to form a mixture, said catalyst precursor being added to said bottoms portion as a catalyst precursor in a virgin petroleum residuum, and (d) subjecting at least a portion of said mixture of step (c) to hydroconversion conditions, in the presence of hydrogen, in a slurry hydroconversion zone to produce a hydroconverted oil.

2. The process of claim 1 wherein the initial boiling point of said heavy bottoms fraction resulting from step (b) ranges from about 650° to about 1050° F.

3. The process of claim 1 wherein said coking conditions include a temperature ranging from about 775° F. to about 1400° F.

4. The process of claim 1 wherein said hydroconversion conditions include a pressure ranging from about 100 to about 5000 psig and a temperature ranging from about 650° to about 1000° F.

5. The process of claim 1 wherein said carbonaceous feed of said coking zone has a Conradson carbon content of at least about 7 weight percent.

6. The process of claim 1 wherein said heavy bottoms fraction of step (b) has a Conradson carbon content of at least 7 weight percent.

7. The process of claim 1 wherein said hydroconversion catalyst precursor is a thermally decomposable metal compound.

8. The process of claim 1 wherein said heavy bottoms fraction of step (b) comprises at least about 10 weight percent materials boiling above 1050° F.

9. The process of claim 1 wherein at least 10 weight percent of the 1050° F.+ materials of said portion of heavy bottoms fraction of step (b) are converted to lower boiling products.

10. The process of claim 1 wherein said coking zone is a delayed coking zone operated at delayed coking conditions, including a temperature ranging from about 775° to 1000° F.

11. The process of claim 1 wherein said coking zone is a fluid coking zone operated at fluid coking conditions, including a temperature ranging from about 850° to about 1400° F.

* * * * *